United States Patent [19]

Tsutsumi

[11] Patent Number: 4,959,930

[45] Date of Patent: Oct. 2, 1990

[54] WASHING MACHINE

[76] Inventor: Katsuji Tsutsumi, 130-2, Fukimae, Makishimacho, Uji-Shi, Kyoto 611, Japan

[21] Appl. No.: 143,853

[22] PCT Filed: Apr. 6, 1987

[86] PCT No.: PCT/JP87/00213

§ 371 Date: Dec. 7, 1987

§ 102(e) Date: Dec. 7, 1987

[87] PCT Pub. No.: WO87/06172

PCT Pub. Date: Oct. 22, 1987

[30] Foreign Application Priority Data

Apr. 7, 1986 [JP] Japan ..... 61-51885
Dec. 17, 1986 [JP] Japan ..... 61-302619

[51] Int. Cl.[5] ..... B24C 3/04

[52] U.S. Cl. ..... 51/426; 51/425; 51/419; 15/3; 134/7

[58] Field of Search ..... 51/432, 424, 425, 426, 51/410, 419, 421, 320–321; 15/3, 95; 134/7

[56] References Cited

U.S. PATENT DOCUMENTS

| | | | |
|---|---|---|---|
| 919,417 | 4/1909 | Carroll | 51/419 |
| 1,522,159 | 1/1925 | Vollmer | 51/419 |
| 1,713,965 | 5/1929 | Hull | 51/426 |
| 2,429,742 | 10/1947 | Barnes | 51/424 |
| 2,632,980 | 3/1953 | Ransohoff | 51/421 |
| 3,323,159 | 6/1967 | Ummel et al. | 15/3 |
| 3,395,412 | 8/1968 | Derwin | 15/3 |
| 4,374,443 | 2/1983 | Mosell | 15/3 |

FOREIGN PATENT DOCUMENTS

| | | | |
|---|---|---|---|
| 0877424 | 4/1953 | Fed. Rep. of Germany | 51/419 |

*Primary Examiner*—Robert A. Rose
*Attorney, Agent, or Firm*—Price, Gess & Ubell

[57] ABSTRACT

A washing machine wherein liquid detergent is applied to shots (A) having relatively low hardness, which are then impinged against an object to be washed (B) by the use of a centrifugal blaster (8; 105), and thereafter the shots are returned to the blaster (8; 105), which machine comprises a recovery device (**7, 10, 13, 15, 16, 19; 102, 107, 112, 112*a*), a detergent supply (17, 117), a safety shutter for preventing improper shot (119), a rubber plate for isolating vibration and sound (129), a sweeper for discharging shots (5; 111), and a rotary body to hold objects to be washed for shifting a shot zone (3; 103**) etc. This washing machine applies to objects which are very dirty and require washing as a whole, such as an iron plate for roasting meat and tableware, a shopping bucket, a portable bottle case, a hook for hanging painted matter etc.

16 Claims, 10 Drawing Sheets

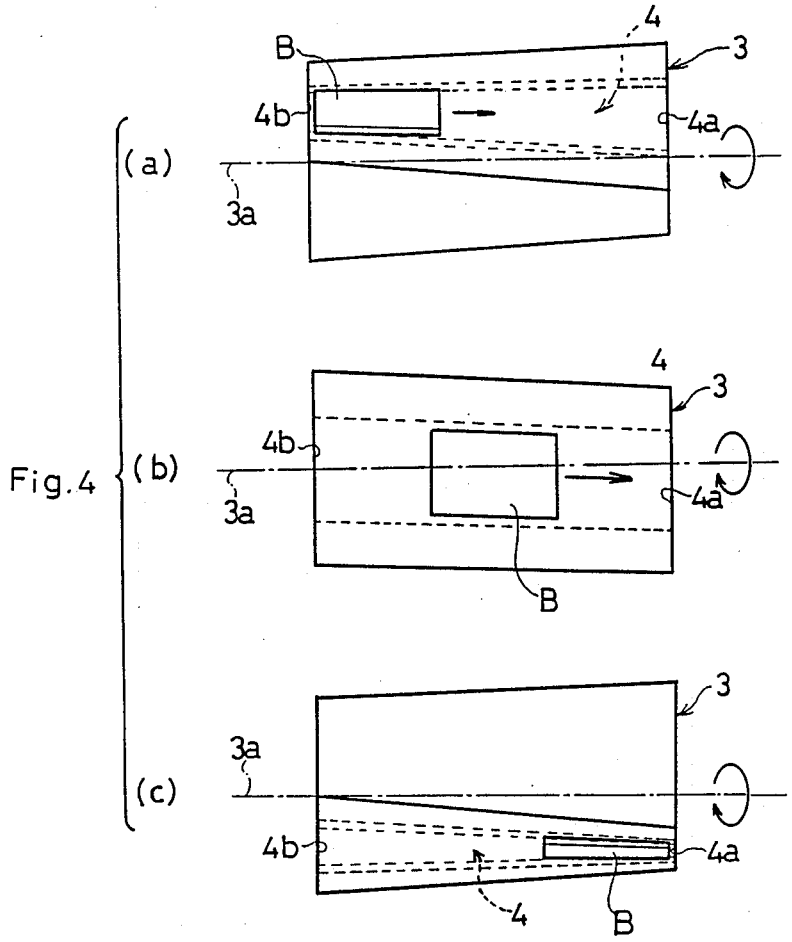
Fig. 5
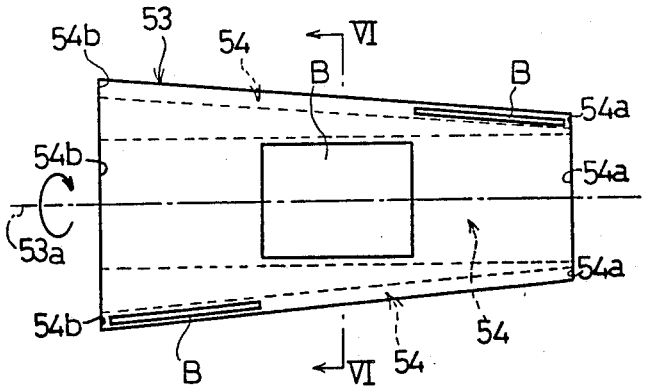
Fig. 6
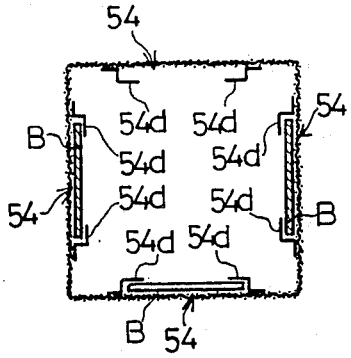

WASHING MACHINE

BACKGROUND OF THE INVENTION (1) Field of the invention

The present invention rotates to a washing machine to be used for washing and cleaning of items to be washed, heavily soiled and required to be washed collectively in a large amount, such as iron plates and tableware for grilled meat employed in restaurants, shopping baskets used in supermarkets, bottle cases for transport employed for carrying a plurality of bottles, hooks for suspending items to be painted used in painting processes, etc.

(2) Description of prior arts

To the iron plates for grilled meat employed in restaurants, oily component and carbonized substances etc. of cooking materials tend to adhere strongly, and due to the fact that such iron plates are used in a large number, excessive labor and expenses are required if normal labor is required in the washing of such objects to be washed. Meanwhile, the tableware used in restaurants, shopping baskets employed in supermarkets, transport bottle cases used for carrying a plurality of bottles, hooks for suspending items to be painted, employed in the painting processes, etc. are also used in a large number and easily soiled and extreme difficulties have been involved in the washing and cleaning work thereof.

Conventionally, as washing machines for removing such adhering substances, there have been known several arrangements employing rotary brushes, for example, in Japanese Utility Model Laid-Open Publication Jikkosho No. 55-41331, and Japanese Patent Laid-Open Publications Tokkaisho Nos. 55-59873, 56-33073 and 59-82983, etc.

However, in the washing machine employing a rotary brush, if the surface of the object to be washed has undulation or concave and convex portions, cleaning of narrow portions by the brush tends to be insufficient, and there has been such a problem that solid or cubic items such as the tableware, shopping baskets, transport bottle cases, etc. can not be fully washed by brushes.

Meanwhile, there has also been known a washing machine arranged to spray a detergent liquid onto the objects to be washed such as tableware and the like as in a dish washer, but such a conventional machine can not fully display its cleaning effect in the case of stain strongly sticking as in the adhering items referred to earlier.

In order to overcome the disadvantage in the washing action by the liquid detergent alone as described above, various washing apparatuses adapted to spray liquid detergent mixed with particles of polishing material onto the objects to be washed, have been proposed, for example, in Japanese Patent Publication Tokkosho No. 53-4339, and Japanese Patent Laid-Open Publications Tokkaisho Nos. 53-27273 and 54-54459, etc. The prior arts as referred to above, however, are still insufficient in the cleaning function with respect to the objects having soiled, and it is also difficult to efficiently remove the strongly sticking adhering items. Moreover since the liquid detergent must be used in a large amount, much running cost is involved, while a problem related to discharge of the detergent liquid after use must also be brought into consideration.

It is to be noted here that performing the surface finish such as rust removal and the like by directing shot materials onto surfaces of metallic products through employment of a centrifugal blasting unit is conventional, but such a practice, if applied to washing as it is, has an excessively strong polishing action, with a possibility of injuring the objects to be washed, and thus, can not be directly used for the actual applications.

SUMMARY OF THE INVENTION

Accordingly, an essential object of the present invention is to provide a novel washing machine employing centrifugal blasting which is intended to efficiently wash objects to be washed, heavily soiled and required to be washed collectively in a large amount, such as iron plates and tableware for grilled meat used in restaurants, shopping baskets used in supermarkets, bottle cases for transport employed for carrying a plurality of bottles, hooks for suspending items to be painted to be used in painting processes, etc.

The main feature of the washing machine according to the present invention resides in that the washing machine comprises a centrifugal blasting means which employs shots having relatively low hardness and applied with liquid detergent over the surfaces thereof so as to be impinged against an object to be washed, held in a washing chamber within the washing machine, a recovery means which recovers the shots discharged by the centrifugal blasting means for returning to said centrifugal blasting means, and a detergent supply means provided in the course of said recovery means or added to said centrifugal blasting means for causing liquid detergent to adhere on the surfaces of said shots.

According to the washing machine of the present invention, since the shots applied with the liquid detergent on the surfaces thereof are shot or discharged towards the object to be washed, soiling or stain strongly adhering to the objects to be washed may be removed in an efficient manner for cleaning by the cooperation of the shot-cleaning action by the impact force of the shots and the chemical cleaning function by the liquid detergent. Moreover, owing to the fact that the shots can be directed onto the items to be washed through employment of the centrifugal blasting means even an object of a complicated shape having undulation or concave and convex portions may be effectively cleaned in its narrow and small portions. In the above case, even when shots having a hardness lower than that of the shots employed for the conventional centrifugal blasting unit are used, a synergistic effect may be achieved by the cleaning action of the shots as supplemented by the chemical cleaning action of the liquid detergent, and therefore, it is possible to avoid formation of flaws on the surfaces of the items to be washed through selective employment of shots having hardness corresponding to the objects to be washed.

Meanwhile, according to the washing machine of the present invention, since the amount of the liquid detergent to be supplied to the shots may be so small as to be just sufficient for the liquid detergent to adhere over the surfaces of the shots, running cost of the washing machine can be advantageously reduced in cooperation with the fact that the shots may be repeatedly used as described later.

Furthermore, by the washing machine of the present invention, owing to the fact that the liquid detergent is supplied to the shots as directed to the object to be washed, substances adhering to the shots such as oil and fat or the like are brought into a state to be readily removed by the chemical cleaning action of the liquid detergent, and subsequently, when the shots having the liquid detergent adhering there onto are discharged to be impinged against the object to be washed, part of the adhering substances is removed from the shots by the impact force and impact heat produced upon the collision, while the remaining substances are rendered to be still more easily removable. Accordingly, even if the shots are repeatedly used, accumulation of adhering substances such as oil and fat, etc. on the shots can be avoided, thereby to prevent reduction in the shot cleaning effect, and thus, repeated use of the shots may be smoothly carried out by the recovery means.

These and other objects, and features and effects of the present invention will become apparent from the following description of one preferred embodiment of the present invention with reference to the attached drawings.

BRIEF DESCRIPTION OF THE DRAWINGS

In FIGS. 1 through 6 showing are preferred embodiment of the present invention, FIG. 1 is a side elevational view partly broken away, of a washing machine of the present invention, FIG. 2 is a front elevational view thereof also partly broken away, FIG. 3 is a perspective view of a rotary frame employed therein, FIG. 4 are front elevational views each showing functions of the rotary frame as observed from the side of a blasting unit, FIG. 5 is a top plan view showing function of a modified rotary frame as observed from the side of the blasting unit, and FIG. 6 is a cross section at an end face taken along the line VI—VI in FIG. 5.

FIG. 7 is a perspective view thereof partly broken away, FIG. 8 is a longitudinal side sectional view thereof, FIG. 9 is a cross section taken along the line IX—IX in FIG. 8, FIG. 10 is a fragmentary perspective view showing an essential portion thereof, FIG. 11 is a cross section taken along the line XI—XI in FIG. 8, FIG. 12 is a perspective view partly broken away, of a reinforcing rubber plate employed therein, and FIG. 13 is a fragmentary side sectional view showing the state of attaching of the reinforcing rubber plate.

BEST MODE FOR CARRYING OUT THE INVENTION

Figure 1:
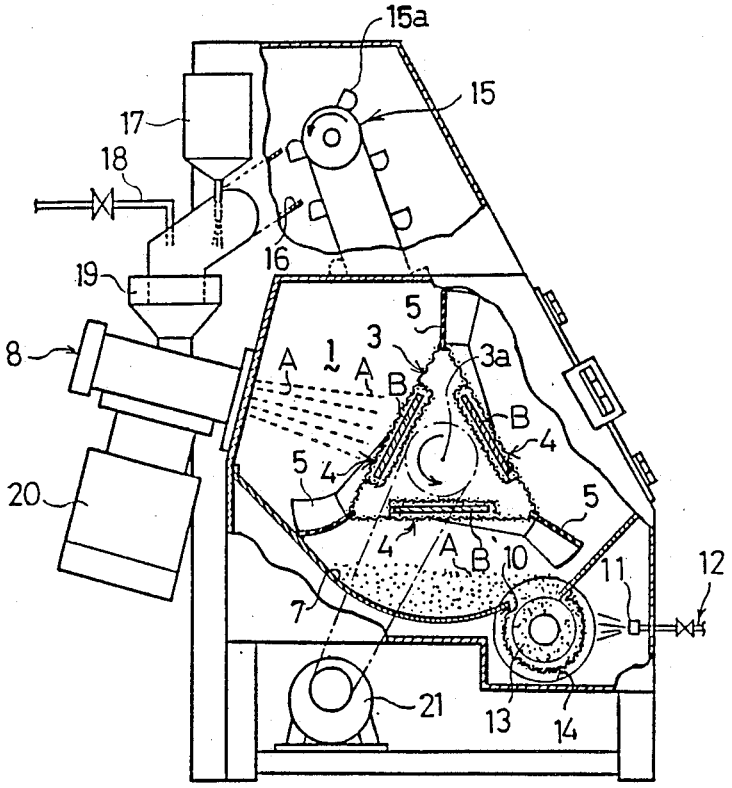

Referring now to the drawings, a first embodiment according to the present invention will be described hereinbelow with reference to FIGS. 1 to 6.

In the first place, it is to be noted that the shots A to be employed in the present invention is produced by mixing a shot material of aluminum, a shot material formed by mixing abrasive grains in urethane resin, and another shot material only of urethane resin at a volume ratio of 2:1:1. For each of the above shot materials, the material having low hardness as compared with the conventional shot materials is selected for adoption. For any of these shots A, spherical shots about 3 mm in diameter are employed. It is to be noted have that the configuration of the shots may be as close to the spherical shape as possible to prevent injury to the object to be washed, but configurations other than the spherical shape can be adopted depending on the material of the shots, speed of discharging shots, hardness of the object to be washed, etc. Moreover, size of the shots may also be suitably selected.

The object B to be washed in the present embodiment is an iron plate for grilled meat, on the surface of which solidified meat juice and meat itself carbonized during heating and cooking are strongly adhered.

Figure 2:
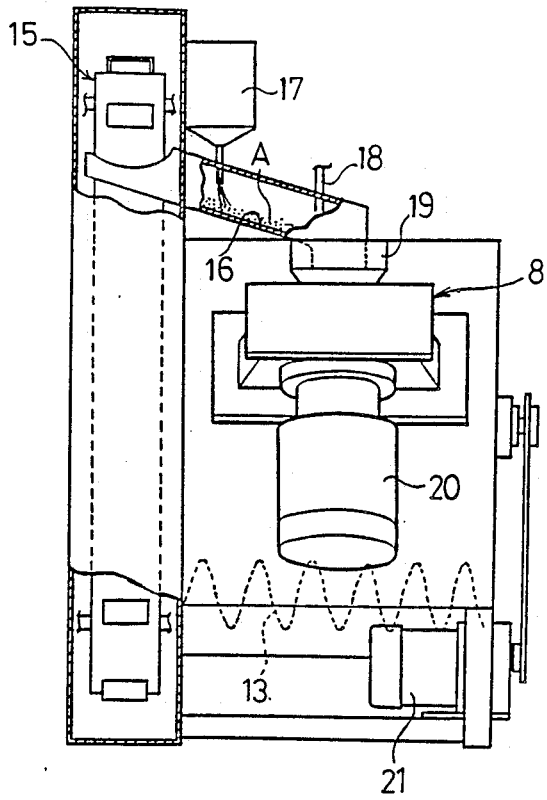

FIGS. 1 and 2 show the washing machine for shot-cleaning the object B through employment of the shots A referred to earlier.

The washing machine has a washing chamber 1 provided therein, at a generally central portion of which, these is laterally disposed a rotary frame body (rotary body) having a triangular cross section and arranged to be rotated with the object B to be washed held thereby. The rotary frame body 3 is rotatably journalled by the opposite side walls of the washing chamber 1.

On the outer side of the side wall for the washing chamber 1, a centrifugal type blasting unit 8 (centrifugal blasting means) is mounted, so as to direct the shots A towards the rotary frame body 3 through an opening formed in said side wall. On the inner lower face of the washing chamber 1, a bottom plate 7 for collecting the shots A as discharged is extended so as to be curved downwardly, while in a portion of the bottom plate 7 at a position remote from said blasting unit 8, there is formed a discharge groove or ditch 10 in a cylindrical cross section for discharging the shots A out of the washing chamber 1, and this discharge ditch 10 is directed in a direction parallel to an axis 3*a* of the rotary frame body 3.

Figure 3:
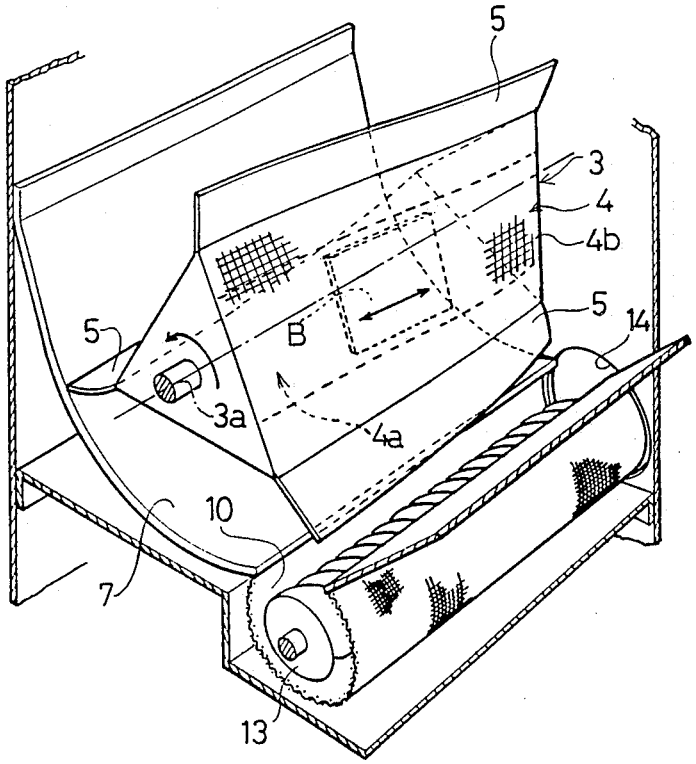
Figure 7:
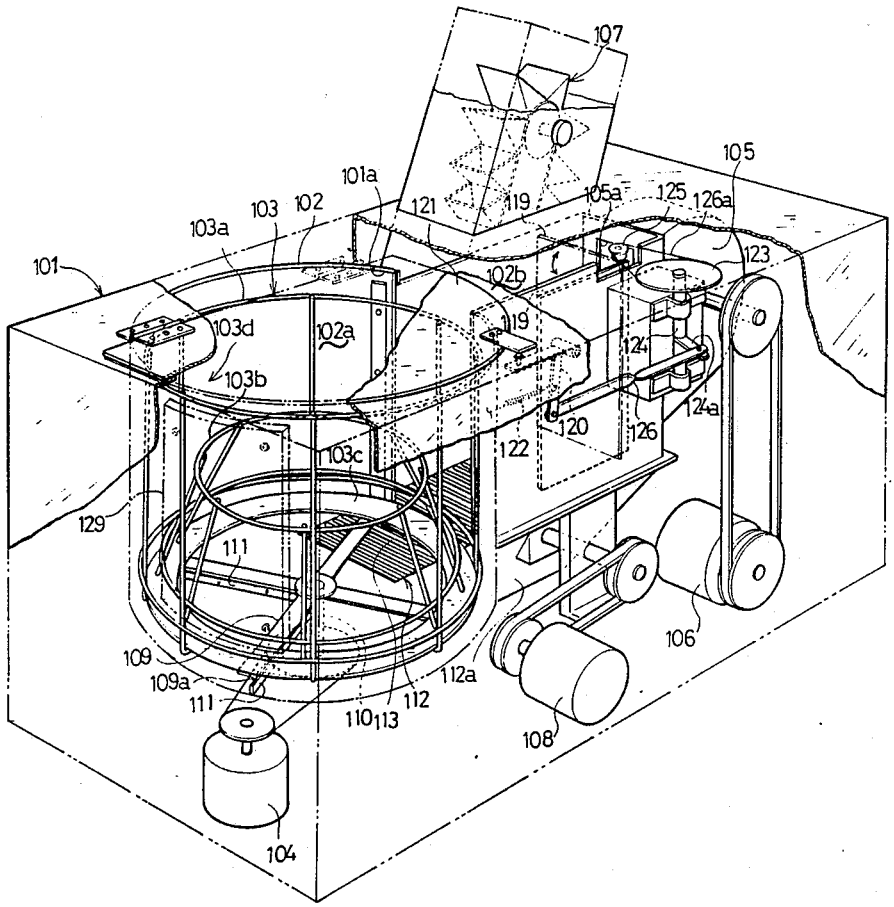
In FIGS. 7 through 13 showing a second embodiment of the present invention.

As shown in FIG. 3, the rotary frame body 3 made of a coarse wire netting is formed into a shape as in a twisted triangular column. More specifically, to each of the side faces of this rotary frame body 3, a coarse metal netting is attached from the inner side, thereby forming a holding passage 4 for slidably holding the object B to be washed for movement in a direction of the axis 3*a* of the rotary frame member 3.

The holding passage 4 referred to above is twisted about the axis 3*a* of the rotary frame body 3 due to the twisted state of the rotary frame body 3 as described above, and as the rotary frame body 3 is rotated, a difference between a high portion and a low portion is produced at opposite ends 4*a* and 4*b* of the holding passage 4, and thus, the object B to be washed may be reciprocatingly displaced between the opposite, ends 4*a* and 4*b* according to said difference in heights. By way of example, as shown in FIG. 3, in a state as observed from the side of the blasting unit 8, when the holding passage 4 is located before the axis 3*a* of the rotary frame body 3 (i.e. at the side of the blasting unit 8), the left side end portion 4*b* of the holding passage 4 becomes higher that the right side end portion 4*a* thereof, so that the object B may be laterally displaced from the right side to the left side with respect to the shot-zone. On the other hand, when the holding passage 4 is located at the other side of the axis 3*a* of the rotary frame body 3 (i.e. at the side opposite to the blasting unit 8), the right side end portion 4*a* becomes higher than the left side end portion 4*b* conversely, and the object B can be laterally displaced from the left side towards the right side.

By the above arrangement, following rotation of the rotary frame body 53, the object B to be washed can be reciprocatingly displaced in directions crossing the shot-zone so as not to produce uneven shooting of the shots.

From each of the ridge line portions of the rotary frame body 3, a sweeper 5 formed by a rubber plate as a sweeper means is extended in a radial direction of the rotary frame body 3. On the other hand, the surface of the bottom plate 7 is formed to have a convex shape having the axis 3*a* of the rotary frame body 3 as a center, so that the sweepers 5 are moved towards the discharge ditch 10 while depressing the surface of the bottom plate 7 through rotation of the rotary frame body 3.

This discharge ditch 10 is formed by a slightly finer wire netting so that the adhering substances removed from the object B can be separated from the shots A. In the internal space within the discharge ditch 10, a screw conveyer 13 is disposed along the discharge groove 10. One end of this screw conveyer 13 faces a discharge port 14 opened in the side wall of the washing chamber 1. Moreover, at the outer side portion of the discharge ditch 10, a shower unit 12 provided with a nozzle 11 for sprinkling water to the discharge ditch 10 for expediting the separation of the soiling is installed along said discharge ditch 10.

At the side portion of the washing chamber 1, a bucket conveyer 15 is erected. The lower portion of the bucket conveyer 15 is connected with the screw conveyor 13 in the vicinity of the outer portion of the discharge port 14, while the upper portion of the bucket conveyer 15 is connected to a chute 16. Since this bucket conveyer 15 is provided in a posture inclined towards the side of said chute 16, in the case where buckets 15*a* of the bucket conveyer 15 discharge the shots A towards the chute 16, the buckets 15*a* are completely turned over as shown in FIG. 1 for positive discharge of the shots A.

The chute 16 as described above is intended to transport the shots A towards the blasting unit 8, and at the upper portion in the course thereof, there is provided a detergent tank (detergent supply means) containing a soap solution (liquid detergent) so as to drop the soap solution onto the shots A passing through the chute 16. Moreover, in the course of the chute 16, a hot water supply pipe 18 is provided to supply hot water into the chute 16 at the predetermined time.

A hopper 19 is provided below the chute 16 so as to supply the shots A or hot water transported through said chute 16 into the blasting unit 8. This blasting unit 8 is driven for rotation by a motor 20, and is arranged to direct the shots A or hot water towards the object B by the centrifugal force produced during the rotation. Moreover, a motor 21 is provided to drive for rotation, the rotary frame body 3 referred to earlier.

Hereinafter, functions of the washing machine having constructions as described so far will be described.

The object B to be washed is accommodated in the holding passage 4 of the rotary frame body 3 so as to be supported thereby. Subsequently, the rotary frame body 3 is driven for rotation, and the shots A are impinged against the rotary frame body 3 by the blasting unit 8.

Of the soiling and stain adhering to the object B, the carbonized substance strongly stuck thereto is removed by the powerful impact by the aluminum shots, while the stain uniformly spreading, for example, of oil and fat, etc. is evenly eliminated by the shots made of soft urethane resin alone and having small impact force. Meanwhile, the shots made of urethane resin mixed with abrasive grains function to remove the sticky principle oil stain, and also to finish the entire surface of the object B by polishing.

As described so far, by using the three kinds of shots different in the magnitude of impact forces, presence or absence of the abrasive grains, etc. in the mixed state, various stains adhering to the object B can be removed in an efficient manner in cooperation with the chemical cleaning action by the soap solution. Accordingly, there are no such inconveniences that too much time is required for the cleaning work of the object B, or the object B is injured by the shot-cleaning, or cracks are formed on the object B thereby.

It is preferable to set the kinds or mixing ratio of the shot material to be mixed depending on the objects to be washed and the substances adhering thereto. By way of example, in the case where the soiling is relatively slight or where the object is made of a comparatively soft material such as a synthetic resin or the like, only the shots made of urethane resin may be employed. Meanwhile, for the resinous shots applied to hard objects to be washed such as iron plates for grilled meat, etc., furuoro-rubber, silicon rubber or the like are suitable besides the urethane resin from the view point of impact-resistance, heat-resistance, hardness and specific gravity, etc., but in the case of the relatively soft object made of a synthetic resin or the like, shots prepared by polyethylene or nylon may also be employed. In any of the cases, shots should preferably have specific gravity larger than about 1.2 in the relation with respect to the liquid detergent.

The rotary frame body 3 formed into the triangular configuration by the coarse metallic wire netting allows the shots A to readily pass from the ridge line portions between the respective objects B and B, towards the inner side of the rotary frame body 3, it is possible to cause the shots A to collide with the reverse faces of the object B located at the confronting faces with respect to the ridge line portions. Accordingly, in the washing machine of the present invention, the front and reverse faces of the object B can be simultaneously subjected to the shot-cleaning, without necessity for turning over and resetting the object B in the course of the washing work.

The shots A impinged upon the object B and the adhering substances removed by the shots A fall onto the bottom portion of the washing chamber 1 so as to be collected on the bottom plate 7. Subsequently, the sweepers 5 sweep the shots A on the bottom plate 7 into the discharge ditch 10. In the discharge ditch 10, the adhering substances remaining on the surfaces of the shots A are washed away by the water spinkled frame the shower means 12, and are caused to drop downward through fine holes of the discharge ditch 10. It is to be noted here that, since each of the sweepers 5 is directed towards the side of the discharge port 14 as shown in FIG. 3 due to the twisted state of the rotary frame body 3, the shots A may be efficiently swept towards the side of the discharge port 14 of the discharge ditch 10 for being smoothly discharged outside.

Subsequently, the shots A are transferred to the lower portion of the bucket conveyer 15 by the screw conveyor 13. The bucket conveyer 15 transports the shots A into the chute 16 disposed at the upper portion of the washing machine, and thus chute 16 supplies the shots A to the blasting unit 8 via the hopper 19. The shots A is applied with the soap solution dropped from the detergent tank 17 as they pass through the chute 16. This soap solution serves to clean the shots A themselves and also to wash the object B to be washed, and is not required to be collected again as stated earlier.

As described so far, in the washing machine of the present invention, since the shots A are arranged to be circulated for use, with the adhering substances transferred onto said shots A being removed through two times of cleaning by water rinsing and cleaning by the soap solution on the passage, superior shot-cleaning effect of the shots can be maintained for a long period of time.

Upon completion of the predetermined washing, the screw conveyer 13 and the bucket conveyer 15 are stopped to suspend discharge of the shots A, with the blasting unit 8 and the rotary frame body 3 being held in operation, and the supply of the soap solution and the sprinkling of water by the shower unit 12 are also suspended. Then, a valve of the hot water supply pipe 18 is opened to supply hot water into the chute 16. The hot water is supplied into the blasting unit 8 via the hopper 19, and is directed towards the object B by the blasting unit 8. After washing the surface of the object B, the hot water flows down onto the bottom plate 7 and is then, swept into the discharge ditch 10 by the sweepers 5.

By the above function, rinsing of the object B is effected, and simultaneously, the stain adhering to the inner face of the washing chamber 1 and the rotary frame body 3 is perfectly washed off. After the rinsing for a predetermined period of time, the object B can be taken out of the washing chamber 1 in a state approximately dried. It should be noted here that the rinsing of the object B to be washed may be effected at a place different from the present washing machine in any desired method.

In the foregoing embodiment, although the recovery means for returning the shots A discharged from the blasting unit 8 to said blasting unit is constituted by the bottom plate 7, discharge ditch 10, screw conveyer 13, bucket conveyer 15, chute 16 and hopper 19, such recovery means may be constituted, for example, by an arrangement provided with a circulating suction pump or circulating tube pump, etc.

Moreover, in the foregoing embodiment, although the soap solution is employed as the liquid detergent, it is possible to employ various chemical detergents having more powerful chemical cleaning effects than the soap solution, while on the contrary, if the soiling is slight, a synthetic detergent may also be applied. Similarly, a detergent supply means may be added to the blasting unit 8.

Furthermore, in the case of the foregoing embodiment, the holding of the object B within the washing machine is effected by attaching the object B to the side face of the rotary frame member 3 of the triangular columnar shape made of the metallic netting, the material and shape of such rotary frame body may be modified in any way, while the holding of the object B within the washing machine may be effected, for example, by the tumbler type which effect the shot-discharge while stirring the object to be washed, the table type, or the hanger type, etc.

In the case where the blasting unit directs shots to the object B from above, it is preferable to form a rotary frame body 53 of a square cross section as shown in a modification of FIGS. 5 and 6, with a holding passage 54 inclined with respect to the axis **53*a* of the rotary frame body 53 being provided at the side face of said rotary frame body 53. This holding passage 54 can displaceably hold the object B to be washed for movement between opposite ends 54*a* and 54*b* of said holding passage 54, in positions between the coarse metallic wire netting forming the rotary frame body 53 and a pair of parallel slide rails 54*d* and 54*d* fixed to the rotary frame body 53** from inside.

By the above arrangement, the left side end portion **54*b* becomes higher than the right side end portion 54*a* when the holding passage 54 is at the upper side position of the frame body 53, while on the contrary, the right side end portion 54*a* becomes higher than the left side end portion 54*b* when the holding passage 54 is at the lower side position of said rotary frame body 53, and thus, since the object B can be reciprocatingly displaced in directions to cross the shot-zone following rotation of the rotary frame body 53**, irregular shot application to the object B may be prevented.

Referring to FIGS. 7 to 13, a second embodiment of the present invention will be described hereinafter.

In this embodiment, in an outer casing 101, there are provided a washing chamber **102*a* of a circular shape, and a washing tank 102 forming a shot space 102*b* in a rectangular configuration. Within the washing chamber 102*a*, a rotary frame body (rotary body) 103 for accommodating the object B is rotatably disposed, with its axis being approximately vertically directed. A motor 104 is provided to drive this rotary frame body 103** for rotation.

At the rear face side of the rear wall for the shot space **102*b*, a centrifugal type blasting unit (centrifugal blasting means) 105 is provided for impinging the shots A against the rotary frame body 103. A motor 106 is disposed to drive this blasting unit 105. At the side lower portion of the washing tank 102, there is provided a storage tank 114 in which the shots A discharged are to be collected. A bucket conveyer 107 for transferring the shots A collected in the storage tank 114 into the blasting unit 105 is provided to extend from the side lower portion to the side upper portion of the washing tank 102. A motor 108 is provided to drive this bucket conveyer 107**.

The rotary frame body 103 is constituted by fixing an outer frame **103*a* and an frame 103*b* to a bottom plate 103*c* in an annular. The outer frame 103*a* is erected generally vertically. The inner frame 103*b* is inwardly inclined at the upper portion, and defines an inlet/outlet port 103*d* for the object B largely opened upwardly with respect to said outer frame 103*a*. This rotary frame body 103 is rotatably supported by a rotary shaft 110 extending through the bottom portion of the washing tank 102 through a support member 109 of a cross shape fixed to the undersurface of the bottom plate 103*c***.

Sweepers 111 as a sweeper means each made of a rubber plate are disposed along the support member 109 so as to be directed downward. The support member 109 has an inverted L-shape in cross section, and each of the sweepers 111 is detachably mounted on the downwardly directed side wall **109*a* of said support member 109 by bolts and nuts. The sweepers 111 depress, as the lower edges thereof, the bottom face of the cleaning chamber 102, and following rotation of the rotary frame member 103, sweep the shots A on the bottom face into a discharge port 112 to be described later. It is to be noted here that the rubber plate for the sweeper 111** may be replaced by a brush or the like.

Figure 9:
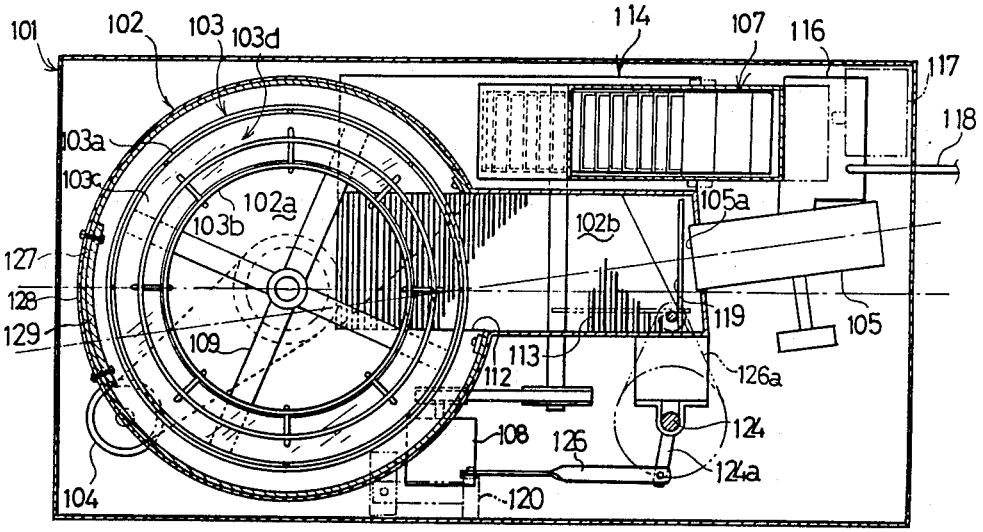

The shot port 105*a* of the blast unit 105 is directed towards the rotary frame body 103 from an opening formed in the rear wall of the shot space 102*b*. The shots A are impinged against the rotary frame body 103 from the blasting unit 105. In the present embodiment, as shown in FIG. 9, the direction for discharging the shots A is slightly deviated from the axis of the rotary frame body 103 towards the side to receive the rotation, so that the shots A are impinged against the object B at an angle of incidence, which should favorably be in the range of 5°–50°.

By the above arrangement, the amount of displacement of the outer frame 103*a* of the rotary frame body 103 with respect to the object B can be increased. Moreover, by the angle of incidence as referred to above, the shots A can be caused to collide with the surface of the object B by being laterally moved from the side portion. As a result, it is possible to prevent formation of irregular shot application or uneven washing corresponding to the configuration of the outer frame 103*a*, at the specific position of the object B to be washed.

In the bottom portion of the washing tank 102, the discharge port 112 as referred earlier is formed to extend from the blasting unit 105 to the vicinity of the axis of the rotary frame body 103. The discharge port 112 is provided with a discharge chute 112*a* inclined towards the lower part of the bucket conveyer 107. It is to be noted here that a grating 113 is applied onto the upper open edge of the discharge port 112 so as to prevent items other than the shots A and adhering substances removed from the object B, from entering the discharge port 112.

Figure 8:
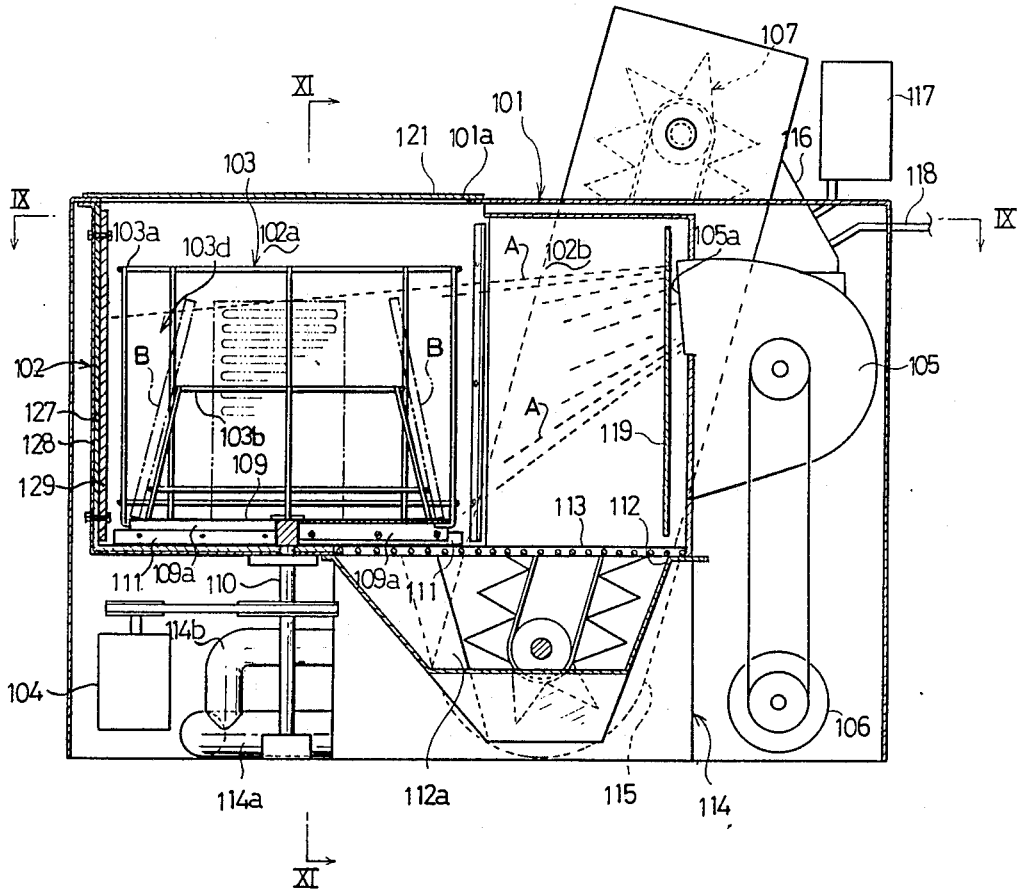

Within the storage tank 114 referred to earlier, a punched plate 115 of a U-shape as shown in dotted lines in FIG. 8 is attached. The shots A are collected onto this punched plate 115. The diameter of the holes in the punched plate 115 is smaller than the diameter of each shot A. Meanwhile, in the storage tank 114, the detergent liquid is stored at a predetermined level so that the lower portion of the punched plate 115 is immersed therein. Within the storage tank 114, the adhering substances removed from the object B are separated from the shots A and settled below the punched plate 115. In this case, it is favorable if the separation of the stain is accelerated by causing the detergent liquid in the storage tank 114 to flow or by causing the punched plate 115 to vibrate. It is to be noted that there are further provided a drain pipe 114*a* for discharging the detergent liquid from the storage tank 114 and an overflow pipe 114*b*.

The shots A collected on the punched plate 115 of the storage tank 114 are transferred to the blasting unit 105 at the upper part by the bucket conveyer 107. A supply chute 116 is connected to the blasting unit 105 for supplying the shots A to said blasting unit 105. Moreover, a detergent tank (detergent supply means) 117 and a water supply pipe 118 are connected to the supply chute 116 so as to suitably feed the liquid detergent and water to the shots A. In the present embodiment, the recovery means is constituted by the washing tank 102, discharge port 112 and its discharge chute 112*a*, storage tank 114, bucket conveyer 107, and supply chute 116.

In the washing tank 102, a movable type safety shutter 119 is provided between the blasting unit 105 and the rotary frame body 103. This safety shutter 119 is pivotally supported at its one side, by the side wall of the washing tank 102 so as to be rotatable between an open position for allowing the shots A to pass therethrough and a closed position for shutting off the passing of said shots A.

Figure 10:
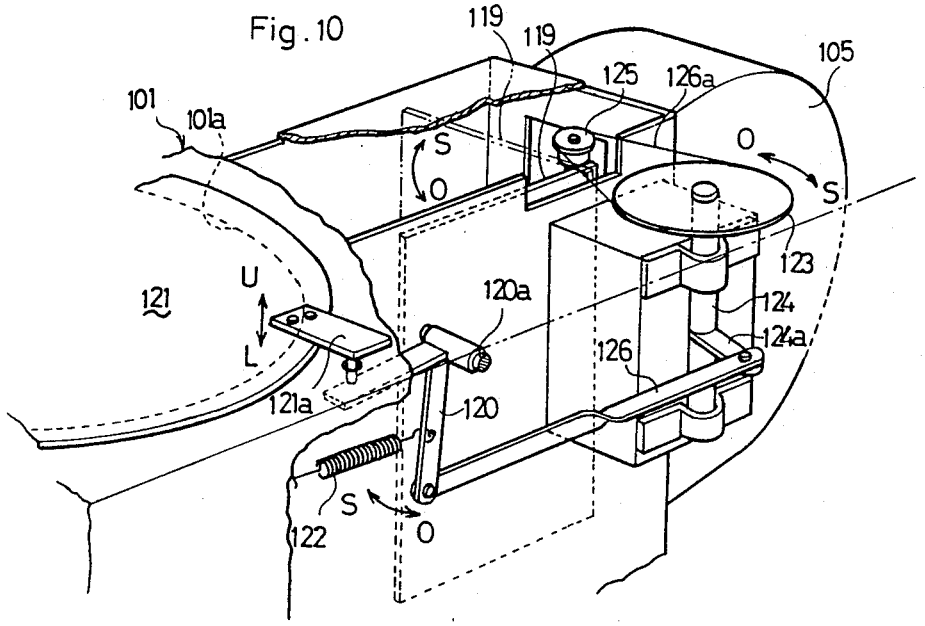
Figure 11:
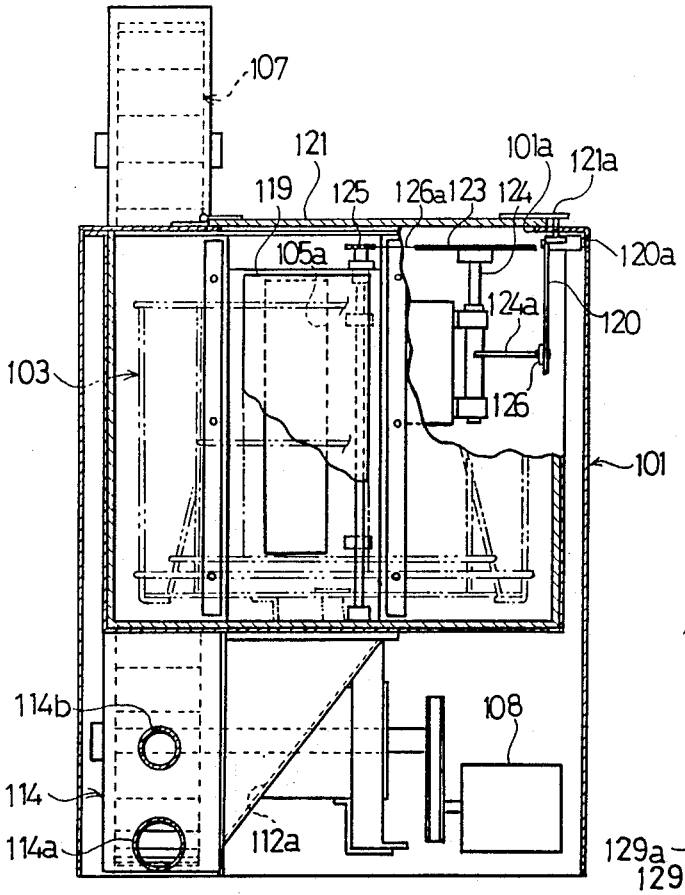

On the other hand, as shown in FIG. 10, in the vicinity of the opening 101*a* of the outer casing 101, an inverted L-shaped rotary lever (movable member) 120 is rotatably provided for rotation about a pivotal axis 120*a* (S⟷O directions). When the open/close lid 121 for opening a closing the opening 101*a*. (U⟷L directions) is located as the lid closing position, the rotary lever 120 is depressed for movement in the direction of L by the weight of said open/close lid 121 through a depressing portion 121*a* thereof, and is rotated in the direction of O. Moreover, a coil spring (biasing means) 122 is connected between the rotary lever 120 and the outer casing 101 so as to urge in such a manner that the rotary lever 120 is rotated for restoration in the direction of S when the open/close lid 121 is opened in the direction of U.

At the outer side of the washing tank 102, a rotary shaft 124 having a large diameter sprocket 123 at its upper end is rotatably provided. On the other hand, at the upper end of the pivotal shaft of the safety shutter 119, a small diameter sprocket 125 is provided, with a chain 126*a* being passed around these large and small diameter sprockets 123 and 125. A projection 124*a* is provided on the rotary shaft 124, and the forward end thereof and the lower end portion of said rotary lever 120 are connected by a connecting lever 126, whereby the rotation of the rotary lever 120 in the directions O⟷S is transmitted to the safety shutter 119 for rotation thereof in the O⟷S directions. Thus, the large diameter sprocket 123, rotary shaft 124 and its projection 124*a*, small diameter sprocket 125, chain 126*a*, and connecting lever 126 constitute a connecting mechanism for rotating the safety shutter 119 from the close position to the open position in association with the depression of the rotary lever 120.

When the open/close lid 121 is in the closed position, as the rotary lever 120 is depressed in the direction of L for rotation in the direction of O, the safety shutter 119 is rotated (in the direction O) to the open position which allows the passing of the shots A as shown by solid lines in FIG. 10, whereby the object B to be washed can be subjected to the shot washing. Meanwhile, in the case where the open/close lid 121 is not at the closed position during insertion or withdrawal of the object B or due to faulty operations, etc., the safety shutter 119 is rotated (in the direction S) to the closed position for shutting off passing of the shots A as shown by imaginary lines in FIG. 10, in association with the rotation of the rotary lever 120 for restoration in the direction S, whereby impinging of the discharged shots against an operator can be advantageously prevented. It is more favorable if the arrangement is so made that the driving of the blasting unit 105 is shut off along with the functioning of the safety shutter 119.

Over the entire inner wall of the washing tank 102, two rubber sheets, i.e. a thick film rubber sheet 127 and a thin film rubber sheet 128 are applied. Meanwhile, at the portion of the inner wall of the washing tank 102 confronting the blasting unit 105, another reinforcing rubber plate (rubber plate) 129 is applied as shown in FIG. 13 besides said thick film rubber sheet 127 and the thin film rubber sheet 128 referred to above.

Figure 12:
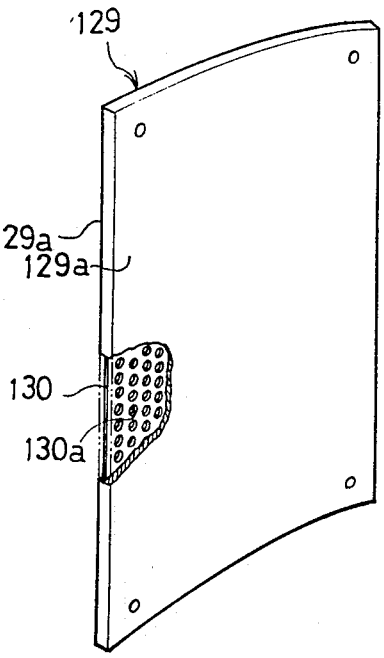
Figure 13:
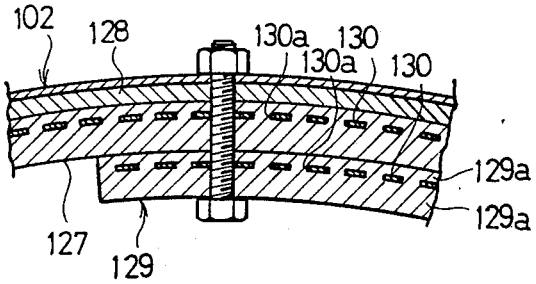

As shown in FIGS. 12 and 13, the reinforcing rubber plate 129 is formed by covering front and rear faces of a punching sheet (a metallic core member) 130 with rubber layers 129a, 129a. For these rubber layers 129a, synthetic rubbers such as urethane rubber, silicone rubber, etc. harmless from the viewpoint of dietary hygiene are employed, such rubber material in a liquid form is poured into a mold frame applied on the punching sheet 130 for subsequent curing or hardening. These rubber layers for the front and reverse faces are integrally formed through small holes 130a in the punching sheet 130. It is to be noted that the thick film rubber sheet 127 referred to earlier is also formed in the similar manner as in this reinforcing rubber plate 129.

By applying this reinforcing rubber plate 129 onto the inner wall of the washing tank 102, the washing tank 102 and shots A are protected against import force at the collision so as to maintain durability thereof for long periods, while the noise at the collision may be reduced for suppression of such noise.

Moreover, by the covering of the punching sheet 130 with the rubber layers 129a, 129a at the front and reverse faces, the expansion and contraction of the rubber layer 129a in the planar direction of the punching sheet 130 may be regulated by said punching sheet 130. As a result, even when the shots A should collide against the reinforcing rubber plate 129 at very large impact force, the deterioration of the rubber layers 129a by the vibrations in the planar direction can be prevented for use for long periods.

Furthermore, since the reinforcing rubber plate 129 is preliminarily formed into a shape and size capable of covering only the necessary portions as shown in FIG. 12, and may be exchangeably attached to such portions through bolts and nuts. Since this reinforcing rubber plate 129 is imported with shape retaining property by the punching sheet 130, the attachment thereof may be fully effected by only fixing four corners of the plate with the bolts and nuts, whereby such portions which are subjected to the impact force by the shots A most strongly can be reinforced in an efficient manner, while detaching or attachment of the rubber plate 129 may be readily effected. It is to be noted here that for the metallic core member of the reinforcing rubber plate, a metallic wire netting or the line may also be used besides the punching sheet 130, and that only the front surface of the metallic core material is adopted to be covered by the rubber layer, with the reverse surface thereof exposed as it is.

Subsequently, functioning of the washing machine having the construction as described so far will be described hereinbelow.

After opening the open/close lid 121 so as to open the opening portion 101a of the outer casing 101, the object B to be washed is inserted, through the inlet/outlet port 103d, between the outer frame 103a and the inner frame 103b of the rotary frame 103 so as to be held thereby.

During the opening of the open/close lid 121 as described above, since the safety shutter 119 is located at the closed position, there is no possibility that the shots A are impinged upon the operator even if the blasting unit 105 is started by mistake. Similarly, there is no danger even when the open/close lid 121 is erroneously opened during the shot-cleaning. The work for causing the object B to be supported by the rotary frame body 103 can be readily effected through the inlet/outlet port 103d largely opened. The object B to be washed is stably hold by said rotary frame body 103 by the weight thereof. It is to be noted that in the case where the object B leans against the inner frame 103b of the rotary frame body 103, with no possibility of inclining towards the outer side in the radial direction by its centrifugal force even if the rotary frame body 103 is rotated, the outer frame 103a can be omitted if stopping protrusions is provided on the bottom plate 103c of the rotary frame body 103.

Upon closing of the open/close lid 121, the safety shutter 119 is rotated to the opened position to allow the passing of the shots A. Subsequently, the rotary frame body 103 is rotated (counterclockwise direction in FIG. 9) to start the blasting unit 105.

The object B is stably held on the rotary frame member 103 by its weight so as not to be displaced with respect to the rotary frame body 103, said object B is positively guided into the shot-zone following rotation of the rotary frame body 103 and passes said shot-zone at a constant speed. As a result, scattering in the shot-amount with respect to the object B due to deviation of the object B from the shot-zone or variation in the passing speed can be prevented, with a consequent prevention of irregular shot application.

The shots A impinged and the stain removed from the surface of the object B by the shot A fall onto the bottom face of the washing chamber 102 for accumulation. Then, the sweeper 111 in the cross shape provided on the under surface of the bottom portion of the rotary frame member 103 sweeps such shots A and the soiling into the discharge port 112. The shots A collected in the storage tank 114 through the discharge chute 112a are separated from the stain in said storage tank 114, and thereafter, transferred to the blasting unit 105 by the bucket conveyer 107.

The shots A are supplied to the blasting unit 105 through the supply chute 116. In this case, the liquid detergent or water is suitably supplied to the shots A. These liquid detergent and water are discharged together with the shots A, and serves for cleaning of the object B and also for the shots A themselves.

In the present embodiment, the rotary frame body 103 for holding the object B is provided in the longitudinal direction, with its upper portion being opened upwardly to provide the inlet/outlet port 103d for the object B, while the opening 101a is provided, at the upper portion of the rotary frame body 103, in the outer casing 101, and therefore, the work for holding the object B in the washing chamber 102a or for taking out said object from the washing chamber 102a can be effected only by the upward and downward displacement of the object B, and thus, mounting and dismounting of the object B following the washing work is facilitated.

Figure 14:
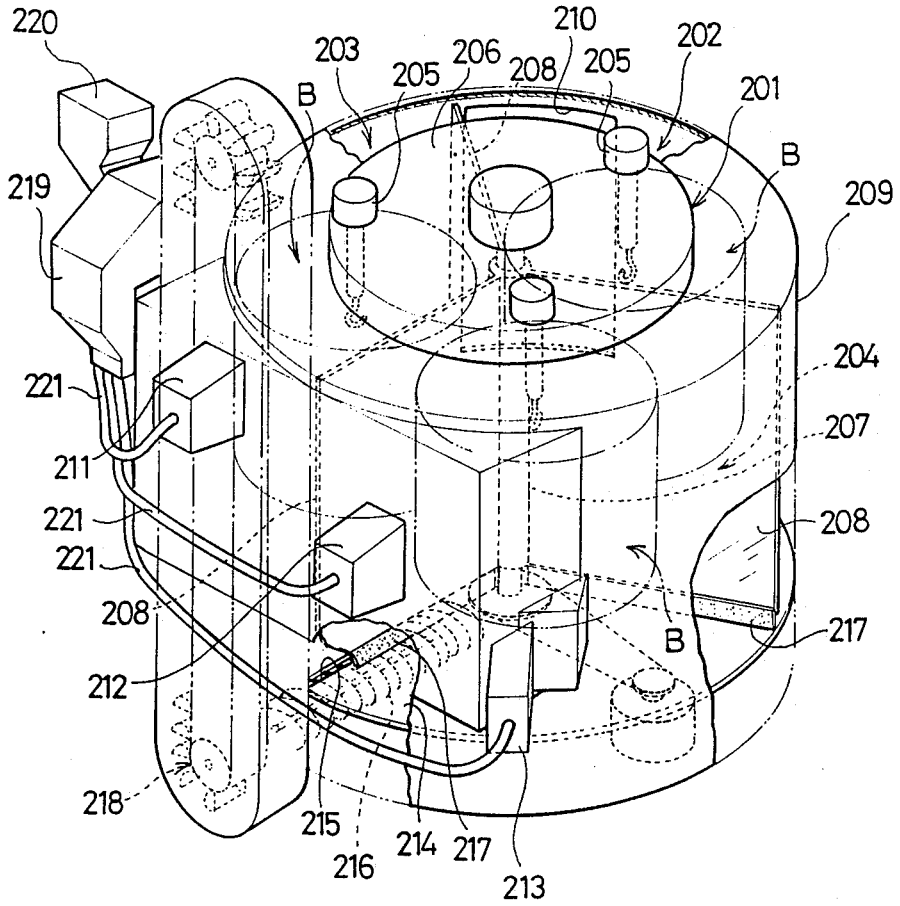
FIG. 14 is a schematic perspective view showing a third embodiment of the present invention.

Referring further to FIG. 14, a third embodiment of the present invention will be described.

In this embodiment, three washing spaces are provided around the rotary body 201, while these washing spaces are arranged to be rotated intermittently through 120° among the inlet/outlet position 202 of the object B, and first and second shot positions 203 and 204.

The rotary body 201 includes hook portions 205 to suspend the object B at each washing space, and also to rotate said object B in a horizontal plane, a circular top plate 206 on which said hook portions 205 are provided, and a rotary driving shaft 207 having said circular top plate 206 fixed at its upper end. The respective washing spaces are partitioned from each other by three partition walls 208 extending outwardly from the shaft 207.

The outer casing 209 in a cylindrical configuration is formed with an inlet/outlet port 210 at an inlet/outlet position 202, and is provided with one blasting unit 211 at a first shot position 203, and two blasting units 212, and 213 at a second shot position 204. The blasting unit 211 at the first shot position 203 is so set as to imping the shots A against the object B from above, while at the second shot position 204, setting is so made that one blasting unit 212 directs the shot A from the side portion of the object B while the other blasting unit 213 impinges the shots A from the slantwise lower portion of the object B.

A discharge ditch 215 is provided on the bottom plate 214 of the washing space so as to discharge the impinged shots out of the washing spaces. In the inner space of this discharge ditch 215, a screw conveyer 216 is provided, thereby to discharge the shots A in the discharge ditch 215 out of said discharge ditch 215. Moreover, at the lower edges of the partition walls 208, sweepers 217 as a sweeper means are provided to contact the bottom plate 214 under pressure, and therefore, the shots can be discharged in an efficient manner through utilization of rotation of the rotary body 201.

At the side of the outer casing 209, a bucket conveyer 218 is erected so as to raise the shots discharged from the screw conveyer 216, and then, to supply such shots to the blasting units 211, 212 and 213.

The shots transported upwardly by the busket conveyor 218 is supplied with the liquid detergent by the detergent supply unit 220 after passing through a stain separating unit 219, and are distributed into the respective blasting units 211, 212, and 213 through three tubes 221. The stain separating unit 219 is arranged to screen off only the soiling substances removed from the object B by causing to vibrate, a metallic wire netting with a mesh smaller than the diameter of the shots. It is to be noted here that in the present embodiment, the bottom plate 214, discharge ditch 215 and bucket conveyer 218 constitute the recovery means.

By the present embodiment, according to the intermittent rotation of the rotary body 201, the insertion and withdrawal of the object B, and the shot-cleaning thereof may be effected in a parallel relation. Moreover, since the object B is rotated with respect to the respective blasts 211, 212 and 213, and the shots are impinged from different angles at the first shot position 203 and the second shot position 204, the objects to be washed having complicated concave and convex shapes such as bottle cases and baskets, etc. may be efficiently washed. It is to be noted here that, in this embodiment, depending on the sizes and shapes, etc. of the objects B to be washed, for example, the hooks for suspending the items to be painted used for painting process and the like, may be arranged to be directly suspended by the hook portion 205, or to be suspended by said hook portion after being accommodated in a holding cage of a metallic wire netting, etc. not hindering the passing of the shots.

Figure 15:
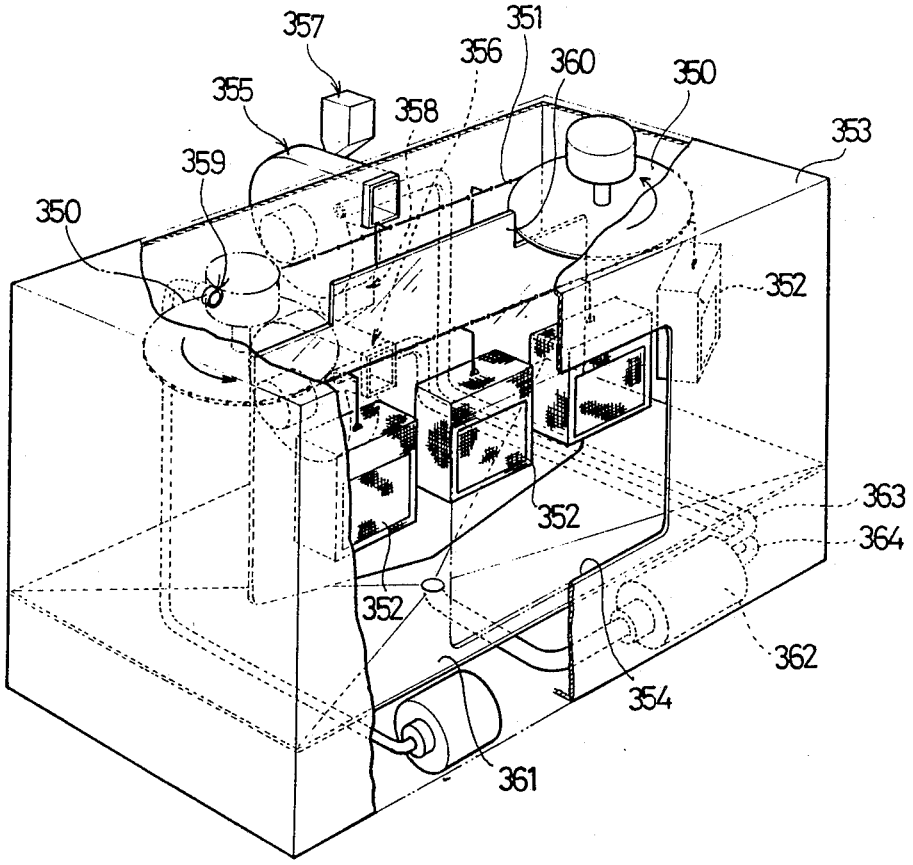
FIG. 15 is also a schematic perspective view showing a fourth embodiment of the present invention.

FIG. 15 shows a fourth embodiment according to the present invention which is capable of shot-washing objects to be washed such as tableware and the like, in a large amount and continuously.

A chain 351 is passed around a pair of left and right sprockets 350, 350, and a plurality of cages 352 for accommodating the objects to be washed are suspended from said chain 351.

An inlet/outlet port 354 for the objects to be washed is formed at the front wall of an outer casing 353, while a set of upper and lower shot units 355 and 356 are disposed at the right inner side of the outer casing 353. The upper blasting unit 355 is adapted to subject the object in the cage 352 to the shot-washing from the slantwise upper portion. The lower blasting unit 356 is arranged to subject the object to the shot-cleaning from the slantwise lower portion. Meanwhile, the respective blasting units 355 and 356 are additionally provided with detergent supply units (detergent supply means) 357 and 358 for supplying the liquid detergent to the shots.

A shower unit 359 is provided at the left inner portion in the outer casing 353 so as to spray water or hot water to the object after the shot-cleaning for rinsing. It is to be noted that, in the case where water is sprayed by the shower unit 359, a heated air blower unit or the like may be disposed at the left side of the shower unit 359 so as to evaporate the water component of the object B by the hot air of the blower unit.

A shielding wall 360 is erected between the blasting units 355 and 356 and the shower unit 359, and also the inlet/outlet port 354, thereby to prevent the shots and hot water from scattering out of this inlet/outlet port 354.

At the lower portion in the outer casing 353, a bottom plate 361 in a funnel shape is provided so as to collect the impinged shots for guiding into a suction pump 362. The suction pump 362 supplies the collected shots to the respective blasting units 355 and 356 through respective transport tubes 363 and 364.

In this embodiment, the recovery means for collecting the impinged shots and returning them to said blasting units 355 and 356 is constituted by the bottom plate 361, suction pump 362, and transport tubes 363 and 364:

It should be noted here that the present invention is not limited in its application to the foregoing embodiment alone, but may be modified in various ways. For examples, shots formed into a sponge-like state by exponding a synthetic resin such as urethane or the like may be impregnated with liquid detergent for impinging upon objects to be washed, whereby the liquid detergent may be applied to the object without a loss, while, by the marked reduction of the hardness of the shots, injury to the surface of a particularly soft object can be advantageously avoided.

Furthermore, when detergents such as Freon (Trade Mark of Dupont Co.—representative example of fluoro-solvent) liquid, trichlene, perchloroethylene, are employed the chemical cleaning function can be further enhanced.

I claim:

1. A washing machine comprising:

a washing chamber to receive an object to be cleaned having an outer casing with an opening;

a lid member for opening and closing the opening in the outer casing;

a centrifugal blasting means, including individual shots having relatively low hardness, for projecting shots against the object;

means for applying a cleaning solvent to said shots;

recovery means for recovering the discharged shots from said centrifugal blasting means;

a safety shutter displaceably provided between said centrifugal blasting means and said washing chamber for movement between an open position which allows passing of the shots discharged from said centrifugal blasting means and a closed position which shuts off passing of said shots;

a movable member provided in the vicinity of said opening of the outer casing so as to be depressed by the open/close lid member during closing thereof;

a connecting mechanism provided between said movable member and said safety shutter so as to displace said safety shutter from the closed position to the open position thereof in association with the movement by the depression of said movable member, and a biasing means for restoring said safety shutter from the open position to the closed position.

2. The washing machine of claim 1 wherein the shots include a mix of a first and second type of shot, the first type of shot being metallic and the second type of shot including a plastic resin material.

3. The washing machine of claim 1 wherein the shots include a plastic resin material shot having an abrasive additive embedded in the resin material.

4. The washing machine of claim 1 wherein the shots are approximately 3 mm in diameter.

5. The washing machine of claim 1 wherein the shots have a sponge-like configuration and can be impregnated with the cleaning solvent.

6. A washing machine comprising:

a washing chamber to receive an object to be cleaned having an outer casing with an opening on an upper face of said outer casing;

a lid member for opening and closing the opening in the outer casing;

a centrifugal blasting means, including individual shots having relatively low hardness, for projecting shots against the object;

means for applying a cleaning solvent to said shots;

recovery means for recovering the discharged shots from said centrifugal blasting means, and a rotary body for accommodating the object to be washed in a rotational movement adjacent a lower portion of said outer casing, said rotary body being upwardly opened at its upper portion so as to form an inlet/outlet port for the object to be washed.

7. The washing machine of claim 6 wherein the shots include a mix of a first and second type of shot, the first type of shot being metallic and the second type of shot including a plastic resin material.

8. The washing machine of claim 6 wherein the shots include a plastic resin material shot having an abrasive additive embedded in the resin material.

9. The washing machine of claim 6 wherein the shots are approximately 3 mm in diameter.

10. The washing machine of claim 6 wherein the shots have a sponge-like configuration and can be impregnated with the cleaning solvent.

11. The washing machine of claim 6 further including a rubber plate provided with a metallic core material and detachably applied onto a portion of an inner wall of the washing chamber against which the shots are impinged.

12. The washing machine of claim 6 wherein said washing chamber is provided with a rotary body which accommodates objects to be washed for rotation, with a sweeper means being provided at an outer side of said rotary body so as to be displaced, while contacting under pressure, a bottom face of said washing chamber.

13. The washing machine of claim 6 wherein said washing chamber is provided with a rotary body which accommodates objects to be washed for rotation, with the direction of discharging shots by said centrifugal blasting means being deviated from an axis of said rotary body.

14. The washing machine of claim 6, further including a rotary body laterally provided in said washing chamber, and a holding passage provided at the side periphery of said rotary body so as to movably accommodate the object to be washed therein for movement between opposite ends thereof, said holding passage being so formed as to produce a difference in heights between the opposite ends thereof when said holding passage passes through the side confronting said centrifugal blasting means as said rotary body rotates.

15. The washing machine of claim 6 further including an outer casing, an opening having an open/close lid and provided on the upper face of said outer casing, and a rotary body for accommodating the object to be washed, provided in a longitudinal direction, at the lower portion within said outer casing, said rotary body being upwardly opened at its upper portion so as to form an inlet/outlet port for the object to be washed.

16. The washing machine of claim 7 wherein a third type of shot is included having a plastic resin material with an abrasive additive embedded in the resin material.

* * * * *